US012286851B2

(12) United States Patent
Arboneaux et al.

(10) Patent No.: US 12,286,851 B2
(45) Date of Patent: Apr. 29, 2025

(54) DEBRIS CATCHER FOR USE IN A SUBTERRANEAN WELLBORE

(71) Applicant: Weatherford Technology Holdings, LLC, Houston, TX (US)

(72) Inventors: Emmett Arboneaux, Houston, TX (US); Brandon Bourg, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/332,436

(22) Filed: Jun. 9, 2023

(65) Prior Publication Data

US 2024/0410244 A1 Dec. 12, 2024

Related U.S. Application Data

(60) Provisional application No. 63/506,581, filed on Jun. 6, 2023.

(51) Int. Cl.

| | |
|---|---|
| ***E21B 27/00*** | (2006.01) |
| ***E21B 37/00*** | (2006.01) |
| ***E21B 43/34*** | (2006.01) |
| ***E21B 43/38*** | (2006.01) |

(52) U.S. Cl.

CPC ..... *E21B 27/005* (2013.01); *E21B 37/00* (2013.01); *E21B 43/35* (2020.05); *E21B 27/00* (2013.01); *E21B 43/38* (2013.01)

(58) Field of Classification Search

CPC ..... E21B 27/005; E21B 43/35; E21B 37/00; E21B 27/00; E21B 43/38

See application file for complete search history.

(56) References Cited

U.S. PATENT DOCUMENTS

| | | | | |
|---|---|---|---|---|
| 672,097 | A * | 4/1901 | Eastman | E21B 43/082 166/158 |
| 2,234,493 | A * | 3/1941 | Howard | E21B 43/10 166/144 |
| 2,248,124 | A * | 7/1941 | Scaramucci | E21B 33/14 166/151 |
| 2,862,563 | A * | 12/1958 | Thompson | E21B 33/12 166/142 |
| 3,515,210 | A * | 6/1970 | Perkins | E21B 43/082 166/205 |
| 8,800,660 | B2 | 8/2014 | Fishbeck et al. | |
| 9,909,390 | B2 | 3/2018 | McNabb et al. | |
| 10,465,445 | B2 | 11/2019 | Getzlaf et al. | |
| 10,683,728 | B2 | 6/2020 | Kellner et al. | |
| 11,459,874 | B1 | 10/2022 | Stair et al. | |
| 2006/0213667 | A1* | 9/2006 | Mashburn | E21B 21/002 166/227 |
| 2009/0084553 | A1* | 4/2009 | Rytlewski | E21B 43/08 166/305.1 |
| 2010/0032169 | A1* | 2/2010 | Adam | E21B 43/105 166/382 |

(Continued)

*Primary Examiner* — Robert E Fuller
*Assistant Examiner* — Neel Girish Patel
(74) *Attorney, Agent, or Firm* — Booth Albanesi Schroeder LLC; Peter V. Schroeder

(57) ABSTRACT

A debris catcher assembly includes a debris filter assembly having a selectively operable valve. such as a rupture disk, to allow a secondary flow path should the debris filter assembly become clogged with debris.

16 Claims, 3 Drawing Sheets

(56) References Cited

U.S. PATENT DOCUMENTS

| | | | | |
|---|---|---|---|---|
| 2011/0186306 | A1* | 8/2011 | Marya | E21B 33/12 166/386 |
| 2012/0175111 | A1* | 7/2012 | Mashburn | E21B 21/002 166/278 |
| 2012/0199349 | A1* | 8/2012 | Themig | E21B 33/12 166/135 |
| 2015/0068727 | A1* | 3/2015 | Hern | E21B 23/08 166/114 |
| 2016/0116098 | A1* | 4/2016 | Ewing | F16K 1/00 138/30 |
| 2019/0203565 | A1* | 7/2019 | Reed | E21B 21/103 |
| 2020/0095845 | A1* | 3/2020 | Watkins | E21B 33/1208 |
| 2022/0106853 | A1* | 4/2022 | Hallundbæk | E21B 33/1243 |
| 2022/0325611 | A1* | 10/2022 | Lehrling | E21B 43/02 |

* cited by examiner

DEBRIS CATCHER FOR USE IN A SUBTERRANEAN WELLBORE

CROSS-REFERENCE TO RELATED APPLICATIONS

None.

TECHNICAL FIELD

This disclosure relates generally to oilfield downhole tools and more particularly to methods and apparatus for filtering subterranean fluids flowing through a downhole debris catcher.

BRIEF DESCRIPTION OF THE DRAWINGS

Drawings of the preferred embodiments of the present disclosure are attached hereto so that the embodiments of the present disclosure may be better and more fully understood.

DETAILED DESCRIPTION OF EMBODIMENTS

Figure 1:
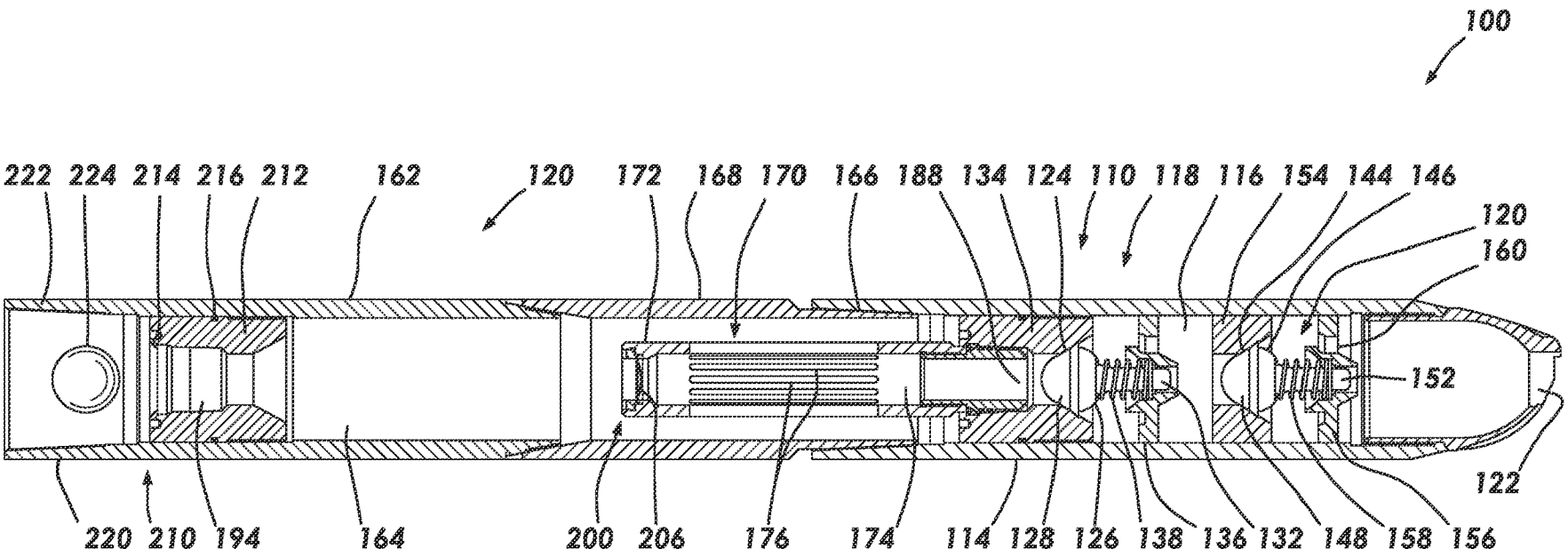
FIG. 1 is a cross-sectional elevational view of an exemplary embodiment of a float assembly and debris catching assembly according to aspects of the disclosure.

A wellbore is formed by using a drill bit on a drill string to drill through a geological formation. After drilling through the formation to a predetermined length or depth, the drill string and drill bit are removed, and the wellbore is lined with casing. To prevent the casing from moving within the wellbore, the casing annulus is filled with cement during a cementing operation. As the casing is run in it is typically filled with a fluid, such as drilling mud.

While running the casing string in the wellbore, it is common to use the wellbore fluid to sustain a portion of the weight of the casing string by floating the casing string in the well fluid. The bottom end of the casing string can include a float assembly, such as a float collar or a float shoe, for this purpose. A float assembly can include one or more unidirectional check valves that allow fluid to pass from the casing to the annulus but prevents fluid from the annulus entering the casing. Uphole from the float assembly one or more receptacles for receiving a device can be positioned, such as a seat for receiving a cement plug that is run down the casing.

During a cementing operation, various fluids, such as spacer fluid, cement, displacement fluid and the like, are pumped down the casing string. One or more plugs can be sent down, separating the fluids during a cementing operation. Although plugs may be solid, blocking fluid flow through the casing, some plugs may include a longitudinal bore therethrough. The bore may be temporarily blocked by a rupture membrane or the like, radially positioned across the bore. Once the plug seats on a receiving device, hydrostatic pressure is built up from above and ruptures the membrane allowing fluid flow through the bore of the plug, through the float assembly, and into the annulus. Multiple plugs may be employed in a cementing operation. In some operations the debris from tools, such as plugs, used uphole from the float assembly, fall down the casing string. Debris can include tool fragments, sacrificial tool parts, rupture disk debris, shear pins and rings, knock-off rods, and the like, as is known in the art.

Downhole tools known as debris catchers are positioned near the end of the casing string, above the float assembly, to catch debris, preventing it from fouling the float assembly, plugging cementing or flow ports, or flowing to the bottom of the well. In operations without a float shoe, the debris catcher prevent the debris from clogging ports and the wellbore. Disclosed herein are exemplary debris catchers for catching wellbore debris.

The terms "above" and "below, and "behind" and "in front," are used herein without respect to whether the wellbore is vertical or horizontal. Similarly, the terms "uphole," "downhole," and the like are used without respect to whether the wellbore is vertical or horizontal. For example, a fluid, tool or the like, said to be above, behind, or uphole of another tool is relatively closer to the wellhead, or having entered the wellbore later, whether along a horizontal or vertical portion of the wellbore. As persons of skill in the art will understand, the disclosures herein are applicable in horizontal and vertical wells.

Figure 2:
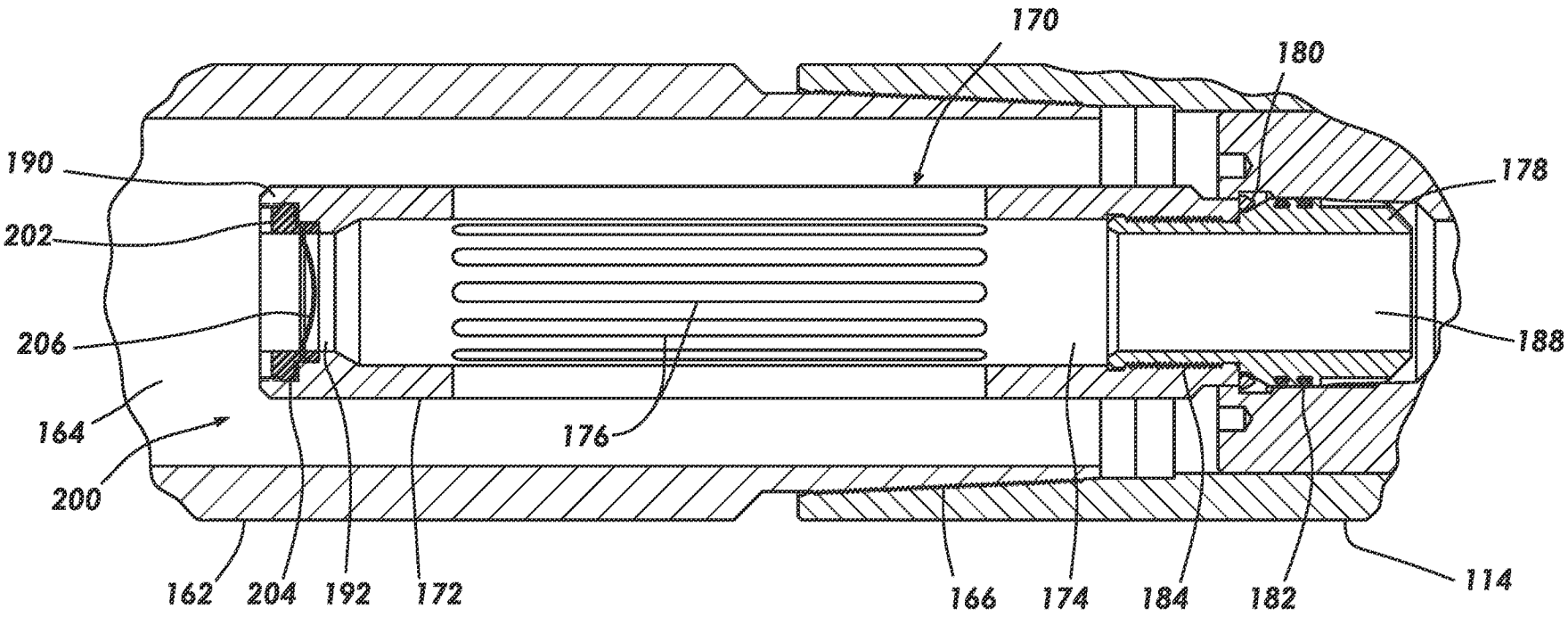
FIG. 2 is a detail in cross-section of the embodiment seen in FIG. 1.
Figure 3:
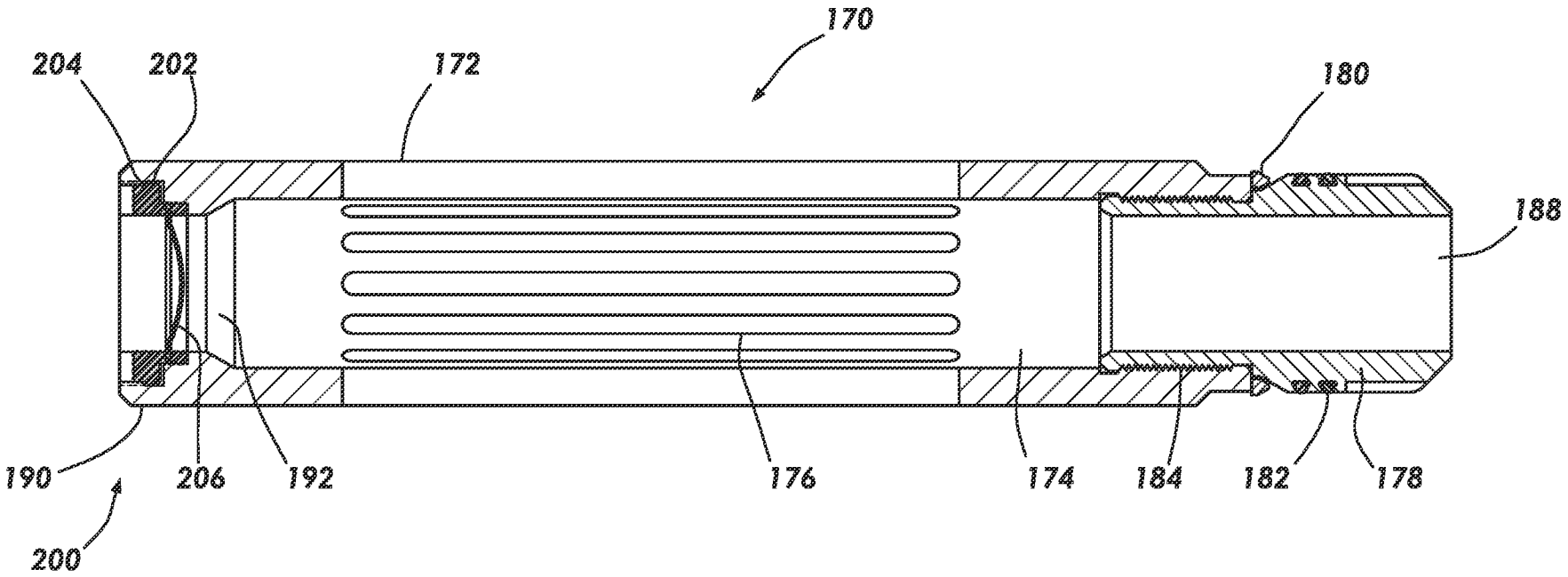
FIG. 3 is a cross-sectional elevational view of an exemplary debris catching assembly according to aspects of the embodiment.

FIG. 1 is a cross-sectional elevational view of an exemplary embodiment of a float assembly and debris catching assembly according to aspects of the disclosure. FIG. 2 is a detail in cross-section of the embodiment seen in FIG. 1. FIG. 3 is a cross-sectional elevational view of an exemplary debris catching assembly according to aspects of the embodiment. Like numbers are used and the figures are discussed together.

FIG. 1 shows an embodiment of a system 100 for catching wellbore debris having a float assembly 110 and a debris catching assembly 120. The system 100 is for use at or near the bottom of a casing or liner string in a wellbore. Typically, the system 100 is used as part of a cementing operation wherein cement is placed in an annulus around a casing positioned in the wellbore. A casing string, tubing string or work string, comprised of a plurality of tubular members, downhole tools and the like, is lowered into a wellbore to a selected downhole location. The system 100 is connected to the string at an upper connection 112, such as a threaded connection, as is known in the art.

The system 100 includes a float assembly 110 disposed at its lower end. The float assembly 110 has a housing 114 which defines a bore 116 for allowing selected fluid flow through the float assembly. The float assembly 110 can include one or more float valves 118 and 120 for controlling fluid flow through the bore 116. In some embodiments, the valves 118 and 120 are one-way valves, or check-valves, configured to allow fluid to flow through the bore 116 and out of the system into the wellbore and casing annulus, but prevent fluid re-entering the system through the bore 116. Fluid can flow out of the float assembly through one or more ports 122 at the bottom of the float assembly. In other embodiments, the system can include a collar assembly, such as a landing collar, with a valveless bore. The exemplary float assembly 110 seen in FIG. 1 can be referred to as a double valve float shoe.

The upper float valve 118 includes a valve seat 124 which cooperates with a valve member 126. The valve member 126 includes a valve head 128 and valve stem 132, the valve head 128 sealing against flow past the valve seat 124 when in contact therewith. The valve seat 124 is defined on an upper insert 134 or other structure positioned in the float assembly. The valve stem 132 reciprocates through a valve guide 136. A biasing assembly, such as spring 138, biases the valve towards the closed, sealed position. A port 140 is defined in the valve guide 136 to allow fluid flow past the valve when the valve is in the open position.

The lower float valve 120 includes a valve seat 144 which cooperates with a valve member 146. The valve member 146 includes a valve head 148 and valve stem 152, the valve head 148 sealing against flow past the valve seat 144 when in contact therewith. The valve seat 144 is defined on an insert 154 or other structure positioned in the float assembly. The valve stem 152 reciprocates through a valve guide 156. A biasing assembly, such as spring 158, biases the valve towards the closed, sealed position. A port 160 is defined in the valve guide 156 to allow fluid flow past the valve when the valve is in the open position.

An exemplary debris catching assembly 120 is seen in FIG. 1, in a detail in FIG. 2, and in part in FIG. 3. The debris catching assembly 120 has a housing 162 defining a throughbore 164 for allowing fluids to flow through the assembly. The debris catching assembly and float assembly are releasably connected together, such as at a make-up thread 166, as is known in the art. The connection 166 allows for the optional use of a pup joint, spacer 168 or the like to extend the effective length of the debris catching assembly, allowing for a larger amount of debris to be caught.

A feature of some embodiments of the device is an extended shoe track, as measured from the landing assembly 210 to the float shoe 110. At the tail end of a cementing operation, a trailing edge of cement can become contaminated with drilling fluid, or other fluids pumped down after the cement. The contaminated cement, if flowed to the casing annulus may fail to set up properly, create a "wet shoe," or otherwise cause issues. Consequently, in an embodiment, the trailing edge of the cement, mixed with contaminant fluid, is trapped in the shoe track rather than being allowed to flow out of the assembly. The shoe track, in an embodiment, is approximately three feet. In other embodiments, the shoe track is approximately six feet long. In other embodiments, the shoe track is of sufficient length to trap the trailing edge of contaminated cement from a cementing job. Where make-up of the assemblies requires, a pup joint or the like 168 can be inserted into the assembly to create a longer shoe track.

Interior to the housing 162 is a debris filter assembly 170 comprising a generally longitudinal body 172 defining a bore 174 therethrough and having a plurality of flow apertures 176 defined in the body for allowing fluid to pass between the exterior and the interior of the body 172. The apertures 176 in some embodiments are, as seen in the figures, elongated slots, providing a relatively large flow area, but with the apertures narrow enough to prevent significant debris from flowing therethrough. The debris filter body, in the embodiments shown, comprises an elongate, generally cylindrical tube having a tube wall. The apertures 176 extend through the cylindrical wall of the tube. Such an arrangement results in fluid flow through the filter moving radially or having a radial component.

The lower end of the debris filter assembly includes a base member 178 connectable, in some embodiments, to the float assembly 110. In the embodiment shown, the base member 178 connects to the upper insert 134 of the upper valve assembly at a connection 180. The connection is a latch-in collar as shown, but can be any suitable connection as is known in the art. The base member 178 seals against the upper insert 134 at exemplary seals 182. The base member 178 as shown connects to the body 172 at a threaded connection 184. Alternately, the base member 178 can attach to the body by other connection type or can be monolithic with the body. The base member 178 defines a port 188 allowing fluid flow out of the debris filter body and into the float assembly. A cap member 190 can be releasably connected to the body 172 or monolithically formed with the body, as shown. The cap member 190 defines an opening 192 for allowing fluid flow through the cap member. However, the opening 192 is temporarily blocked to fluid flow by a barrier assembly 200.

At the upper end of the debris filter assembly 170, in some embodiments, includes a selectively operable barrier assembly 200. The barrier assembly 200 provides a barrier to flow through the cap member 190 when the tool is run in to the well. The barrier assembly 200, as shown, is operated by hydraulic pressure, namely by increasing fluid pressure in the string above the debris catching assembly to open the barrier assembly. In some embodiments, the barrier assembly 200 includes a frangible member 206, such as a rupture disk or the like, as is known in the art, which ruptures upon exposure to a preselected pressure, thereby opening the barrier assembly. In the embodiment shown, the barrier assembly 200 includes a body 202 attachable to the cap member 190, such as at threaded connection 204. It is understood that the barrier assembly can be of any kind known in the art and can be positioned at locations on the debris filter assembly other than at the cap member. The barrier assembly, when open, offers an alternative flow path through opening 206 for fluids into and through the debris filter assembly.

At the upper end of the debris catching assembly 120, in some embodiments, is a seat or landing assembly 210 or landing for catching a dropped or flowed occluding object 224, such as a ball, dart, plug or other object. Such seats and objects are known in the art and not described in detail. The seat assembly includes a body 212 defining a seat 214 for sealing against the occluding object 224. The body 212 seals against the housing 162 at seals 216. The upper end 220 of the debris catching assembly includes a connection 222 for connecting the assembly to a casing string member or the like, such as the exemplary threaded connection shown. When not occluded, fluid flows through a passageway 194 defined in the upper end of the debris catching assembly.

In use, the float assembly 110 and debris catching assembly 120 are assembled at or near the lower end of a tubular string, such as a casing, liner or work string. The float assembly 120 can be a float shoe, float collar or other float device as known in the art. Alternately, the float assembly can be omitted. In the example described here, the assemblies are place at the end of a casing string for a cement job and subsequent operations. The assemblies are run in to the wellbore to a selected location.

The float assembly can be used to float the casing string during run in. The double valves 118 and 120 remain closed during run in, blocking fluid flow upwards from the wellbore into the debris catching assembly and casing string. The biasing members 138 and 158 maintain the valve heads 128 and 148 sealingly seated against the seats 124 and 144, respectively.

Once in position in the wellbore, additional operations are performed in and with the casing string, requiring fluid flow through the casing string, such as drilling fluids, cement, spacer fluids, and displacement fluids. When running fluids, the fluid pressure in the casing bore and debris catcher assembly bore 164 operates the float valves 118 and 120, moving the valve members away from the closed positions to open positions, allowing fluids to flow from the casing bore, into the debris catcher assembly bore 164 through the passageway 194, through the apertures 176 and into the debris filter bore 174, out of port 188 and into the float assembly 110. Fluid flows through the float assembly 110 past the valves 118 and 120 at bores 140 and 160, respectively, and out the lower port 122 into the wellbore and casing annulus. Such operation results in debris, carried by the flowing fluid, becoming trapped in the debris catching bore 164 by operation of the debris filter assembly 170.

Debris is trapped in the debris catching assembly bore 164 by the debris filter assembly 170. The debris is prevented from moving into the interior of the debris filter body 172 by the narrow apertures 176. Fluid, however, is allowed to flow through the apertures 176, through the float assembly 110 and out port 122. When pumping of a fluid down the string ceases, such as at the end of a cement job, for example, the float valves 118 and 120 automatically move to the closed positions due to their biasing mechanisms.

Should the debris catcher assembly become clogged with debris, preventing effective fluid flow through the apertures 176, the selectively operable barrier assembly 200 can be actuated to allow fluid flow into the debris filter assembly 170 through the now-open barrier assembly. By pressuring up within the casing string bore to a preselected pressure, the barrier assembly is opened, such as by breaking the frangible member 206. Upon opening the barrier assembly, fluid flow is restored from the casing string bore, through the debris catching assembly and debris filter assembly, through the float assembly, and out shoe port 122.

In some embodiments, an occluding object is dropped or flowed down to the landing assembly 210 and seats on seat 214, blocking filter fluid flow through the landing assembly and into the debris catching assembly. This allows for pressuring up fluid in the casing string for later operations, such as opening or closing uphole valves, operating perforation equipment, and the like. In some embodiments, the debris filter assembly is removable, such as by drilling, milling, or the like, as is known in the art.

The embodiments disclosed above are illustrative only, as the present disclosure may be modified and practiced in different but equivalent manners apparent to those skilled in the art having the benefit of the teachings herein.

It is, therefore, evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps herein shown, other than as described in the claims.

It is claimed:

1. A debris catcher assembly for use in a wellbore, comprising:

a debris catcher housing having an upper end with a landing assembly for an occluding object, a longitudinal passageway defined through the landing assembly;

a longitudinal bore positioned below the landing assembly and above a debris filter body, the longitudinal bore defined by an interior wall of the debris catcher housing, the longitudinal bore empty of structure along and across the entirety of the longitudinal bore;

the debris filter body positioned within the debris catcher housing below the longitudinal bore, an annulus defined between the debris filter body and the debris catcher housing, the debris filter body defining a bore therethrough, a plurality of apertures defined through the debris filter body allowing fluid flow from the annulus between the debris catcher housing and the debris filter body, the debris filter body having a port at a lower end thereof for allowing fluid flow out of the debris filter body; and the debris filter body having a barrier assembly for allowing selective fluid flow between the longitudinal bore of the debris catcher housing and the debris filter bore, the barrier assembly preventing flow through a flow path defined through the debris filter body, the barrier assembly openable in response to applying hydraulic pressure in the debris catcher housing.

2. The debris catcher assembly of claim 1, wherein the barrier assembly comprises a frangible member.

3. The debris catcher assembly of claim 1, wherein the apertures in the debris filter body are elongated slots.

4. The debris catcher assembly of claim 1, wherein the barrier assembly is mounted in an upper end of the debris filter body.

5. The debris catcher assembly of claim 1, further comprising a float assembly having a housing defining a bore therethrough, the float assembly having at least one float valve for controlling fluid flow through the bore of the float assembly.

6. The debris catcher assembly of claim 5, further comprising an insert positioned in the float assembly housing, the insert connecting to the lower end of the debris filter body.

7. The debris catcher assembly of claim 5, wherein the debris catcher housing is expandable by connecting a pup joint to the lower end of the debris catcher housing.

8. The debris catcher assembly of claim 1, further comprising a shoe track defined between the landing assembly at the upper end of the debris catcher housing and a float valve of the float assembly, the shoe track expandable by the addition of a pup joint between the landing assembly and the float valve.

9. A method of catching debris in a downhole tool assembly positioned in a subterranean wellbore, the method comprising:

flowing fluid through an open upper end of a debris catcher housing; then flowing fluid through a longitudinal passageway defined in a landing assembly, the landing assembly positioned across the debris catching housing; then flowing fluid through an open longitudinal bore extending along a length of the debris catcher housing, the open longitudinal bore defined by an interior wall of the debris catcher housing and having a bore diameter, the open longitudinal bore allowing fluid flow across the bore diameter; then flowing fluid longitudinally along an annulus defined between the debris catcher housing and a debris filter body positioned in the debris catcher housing; then flowing fluid through a plurality of apertures defined in the a debris filter body, and through a bore defined by the debris filter body, the debris filter body positioned within the debris catcher housing;

catching debris in the bore of the debris catcher housing; and then, selectively opening a barrier assembly positioned across a flow path into the bore of the debris filter body to allow fluid flow from the bore of the debris catcher housing into the bore of the debris filter body in response to applying hydraulic pressure in the debris catcher housing.

10. The method of claim 9, further comprising flowing fluid through a float assembly fluidly connected to the debris catcher assembly, and through at least one float valve positioned in the float assembly.

11. The method of claim 10, further comprising flowing cement through the debris catcher housing, debris filter body and float assembly, and trapping a trailing edge of cement in a shoe track defined between a float valve of the float assembly and an upper end of the debris catcher assembly.

12. The method of claim 11, further comprising trapping cement in a pup joint attached to the debris catcher housing.

13. The method of claim 12, further comprising seating an occluding object on a seat defined in the landing assembly.

14. The method of claim 10, wherein a lower end of the debris filter body is latched onto the float assembly.

15. The method of claim 9, further comprising drilling out at least the debris filter body.

16. The method of claim 9, wherein selectively opening a barrier assembly further comprises breaking a frangible member extending across the flow path into the bore of the debris filter body.

* * * * *